US005863303A

United States Patent [19]

Yamamoto et al.

[11] Patent Number: 5,863,303

[45] Date of Patent: Jan. 26, 1999

[54] FUEL OIL COMPOSITION FOR DIESEL ENGINES

[75] Inventors: Masaharu Yamamoto; Naoki Kono; Naomi Murakami; Toshihiko Yoshida, all of Saitama-Ken, Japan

[73] Assignee: Exxon Research and Engineering Company, Florham Park, N.J.

[21] Appl. No.: 4,881

[22] Filed: Jan. 9, 1998

[30] Foreign Application Priority Data

Feb. 26, 1997 [JP] Japan ..... 9-058310

[51] Int. Cl.[6] ..... C10L 1/18

[52] U.S. Cl. ..... 44/398

[58] Field of Search ..... 44/398

[56] References Cited

U.S. PATENT DOCUMENTS

| | | | |
|---|---|---|---|
| 2,284,080 | 5/1942 | Backoff et al. | 44/398 |
| 2,937,933 | 5/1960 | Heisler et al. | 44/398 |
| 3,660,056 | 5/1972 | Dorsch | 44/398 |
| 4,430,093 | 2/1984 | Jenkins, Jr. et al. | 44/398 |
| 4,723,965 | 2/1988 | Yoshida et al. | 44/398 |

*Primary Examiner*—Jacqueline V. Howard
*Attorney, Agent, or Firm*—Joseph J. Allocca

[57] ABSTRACT

The present invention is directed to a fuel oil for diesel engines, which is reduced in the discharges of particulate matters (PM) and carbon dioxide (CO) in exhaust gas upon combustion while retaining a high cetane number, characterized in that the fuel oil composition comprises a mineral oil as a principal component; and (a) 2–13 wt % of one or more dialkyl phthalate compounds represented by the chemical formula (1), and (b) 2–13 wt % of one or more glycol ether compounds represented by the chemical formula (2); and the total content of said components (a) and (b) is from 4 to 15 wt %.

11 Claims, No Drawings

FUEL OIL COMPOSITION FOR DIESEL ENGINES

BACKGROUND OF THE INVENTION

1. Field of the Invention

This invention relates to a novel fuel oil composition, and more specifically to a fuel oil composition for diesel engines, which comprises a mineral oil as a principal component and (a) 2–13 wt % of one or more dialkyl phthalate compounds and (b) 2–13 wt % of one or more glycol ether compounds, the total content of both types of the compounds is from 4 to 15 wt %.

2. Prior Art

Mounted in automobiles, ships and construction machineries, diesel engines are widely spread in the world and still tend to increase year after year in number. Keeping in step with this, there is an increasing demand for diesel engine fuel oil. It is therefore essential to take measures such as conversion of straight run gas oil into heavier one(s) and blended use of cracked gas oil in straight run gas oil. These measures, however, lower the cetane number of gas oil, leading to deterioration in the ignitability in diesel engines. These measures also lead to discharge of still more hydrocarbons, carbon monoxide, nitrogen oxides, sulfurous gas and particulate matters in exhaust gas from diesel engines. From the viewpoints of assurance of normal operation of diesel engines and prevention of air pollution, there are strong social desires for the retention of a high cetane number and reduction of these emission matters.

Concerning gas oil, its cetane number has conventionally been maintained at a necessary level by limiting the extent of conversion of straight run gas oil into heavier one(s), controlling the blending ratio of cracked gas oil to straight run gas oil, or adding an ignitability improver to gas oil. For example, Japanese Patent Application Laid-Open (Kokai) No. SHO 59-207988 discloses a fuel composition added with 0.1 wt % or more of an alkyl nitrate or dialkyl phthalate to improve the ignitability of light gas oil. It also discloses that the addition of the alkyl nitrate permits earlier ignition and at the same time, lowers the rate of a pressure rise upon combustion, thereby including smooth combustion, reducing engine noise and vibrations and improving the quality of diesel smoke.

With a view to reducing emission matters from diesel engines, a great deal of effort has also been made in many aspects, including improvements in the configurations of combustion chambers, exhaust gas recirculation systems, exhaust-gas-cleaning catalytic converters, particulate trap systems, and the quality of fuel oil and lubricating oil. Nonetheless, no sufficient reducing effects have been achieved yet in economy and also in the stability of performance over a long term.

An improvement in the quality of fuel oil has attracted interests as an effective method for the reduction of emission matters because it practically requires no change to the mechanism of diesel engines. For example, Japanese Patent Application Laid-Open (Kokai) No. HEI 3-234793 discloses that fuel oil, which contains dimethylacetal in mineral oil, discharges extremely little black smoke and $NO_x$ and has good ignitability and thermal efficiency. From the economical viewpoint, however, it is difficult to always use a diesel engine fuel oil which contains dimethylacetal in a large quantity.

Japanese Patent Application Laid-Open (Kokai) No. HEI 4-213391 discloses a fuel oil for diesel engines, which makes use of a diesel fuel additive composed of perbasified calcium sulfonate dispersed in an organic solvent. Japanese Patent Application Laid-Open (Kokai) No. HEI 7-70570 discloses one making use of a fuel additive which contains a peroxide of a metal salt of an organic acid. When fuel oil burns, a metal-containing additive itself is discharged as ash in exhaust gas, resulting in the problem that it causes harm to the human body.

Further, Japanese Patent Application Laid-Open (Kokai) No. SHO 59-207988 discloses a fuel composition which contains 0.1 wt % or more of an alkyl nitrate or dialkyl phthalate added to improve the ignitability of light gas oil. It is also disclosed in this Kokai publication that a fuel composition added with a dialkyl phthlate promotes initial combustion to achieve complete combustion and prevents occurrence of smearing. It is, however, difficult to reduce the discharge of particulate matters, which occur under diverse operation conditions of a diesel engine in actual use, by only promoting the initial combustion of the fuel composition.

As has been described above, none of the conventional techniques was able to provide a fuel oil composition for diesel engines, which comprises a mineral oil as a principal component, has a high cetane number and substantially reduces the discharges of particulate matters (hereinafter also called "PM") and carbon monoxide (hereinafter called "CO") in exhaust gas.

It would be an improvement over the above-described conventional art to provide a fuel oil for diesel engines, which has good ignitability owing to the possession of a high cetane number and reduces the discharges of PM and CO in exhaust gas upon combustion.

BRIEF DESCRIPTION OF THE INVENTION

It has been found that addition of a dialkyl phthalate compound(s) and a glycol ether compound in specific amounts to a mineral oil makes it possible to substantially reduce the discharges of PM and CO in exhaust gas upon combustion while retaining a high cetane number.

The present invention provides a fuel oil composition for diesel engines, characterized in that the fuel oil composition comprises a mineral oil as a principal component; and (a) 2–13 wt % of one or more dialkyl phthalate compounds represented by the following chemical formula (1):

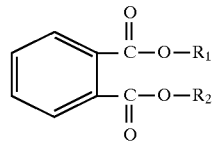

(1)

wherein $R_1$ and $R_2$ are alkyl groups having 1–8 carbon atoms, and $R_1$ and $R_2$ may be the same or different, and (b) 2–13 wt % of one or more glycol ether compounds represented by the following chemical formula (2):

$$R_3O—(R_5O)m—R_4 \quad (2)$$

wherein $R_3$ is an alkyl group having 1–4 carbon atoms, $R_4$ is a hydrogen atom, an alkyl group having 1–4 carbon atoms or an aliphatic acyl group having 2–4 carbon atoms, $R_5$ is an ethylene or trimethylene group which may contain one or more alkyl side chains having 1–4 carbon atoms, and m is a number of from 1 to 4, with the proviso that m is the number of 1 when $R_5$ is a trimethylene group which may contain one or more alkyl side chains having 1–4 carbon atoms and that $R_3$ and $R_4$ may be the same or different; and the total content of said components (a) and (b) is from 4 to 15 wt %.

The present invention relates to a fuel oil composition for diesel engines such as that described above and embraces therein the following embodiments as preferred ones:

(1) The above-described fuel oil composition for diesel engines, wherein the alkyl groups in the dialkyl phthalate compound are alkyl groups having 2–4 carbon atoms.

(2) The above-described fuel oil composition for diesel engines or the fuel oil composition for diesel engines as described above under (1), wherein ($R_4$) the alkyl and aliphatic acetyl groups in the glycol ether compound are alkyl and aliphatic acetyl groups having 2–4 carbon atoms.

(3) The above-described fuel oil composition for diesel engines or the fuel oil composition for diesel engines as described above under (1) or (2), wherein the contents of the dialkyl phthalate compound and glycol ether compound are each from 2 to 8 wt % and the total content of both types of the compounds is from 4 to 10 wt %.

(4) The above-described fuel oil composition for diesel engines or the fuel oil composition for diesel engines as described above under (1), (2) or (3), wherein the dialkyl phthalate compound is diethyl phthalate.

(5) The above-described fuel oil composition for diesel engines or the fuel oil composition for diesel engines as described above under (1), (2), (3) or (4), wherein the glycol ether compound is diethylene glycol dimethyl ether.

DETAILED DESCRIPTION OF THE INVENTION

The present invention will hereinafter be described in detail. The fuel oil composition according to the present invention for diesel engines comprises the mineral oil as a principal component and contains the one or more dialkyl phthalate compounds and the one or more glycol ether compounds in the specific amounts.

(A) MINERAL OIL

The mineral oil for use in the present invention can be a mineral oil fraction which contains 50% or more of a petroleum fraction having a flash point of 40° C. or higher and, as distillation characteristics, a 90% distillation temperature of 360° C. or lower. Examples of the mineral oil can include kerosene, gas oil specified under JIS K2204, and fuel oil A specified under JIS K2205. As the above-described petroleum fraction, it is possible to use either singly or in combination a petroleum fraction produced by atmospheric distillation of crude oil and petroleum fractions obtained by subjecting the petroleum fraction, which has been obtained by the atmospheric distillation of crude oil, to further processing such as hydrocracking or catalytic cracking. The mineral oil for use in the present invention may have a H/C (atomic ratio) of from 1.7 to 1.9. If the H/C ratio is smaller than 1.7, the resulting fuel oil composition for diesel engines may not be allowed to fully burn in each combustion chamber of a diesel engine, resulting in greater discharges of PM and CO. If the H/C ratio exceeds 1.9, the resulting fuel oil composition for diesel engines generally produces low heat of combustion per unit volume and is inferior in the running fuel economy [mileage/fuel oil km/l)] of diesel-powered automobiles although the fuel oil composition for diesel engines produces high heat of combustion per unit weight.

(B) DIALKYL PHTHALATE COMPOUNDS

The dialkyl phthalate compounds for use in the present invention are represented by the following chemical formula (1):

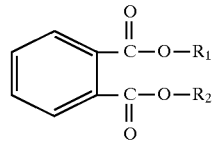

(1)

wherein $R_1$ and $R_2$ are alkyl groups having 1–8 carbon atoms, and $R_1$ and $R_2$ may be the same or different.

The alkyl groups ($R_1$ and $R_2$) in the dialkyl phthalate compounds for use in the present invention have 1–8 carbon atoms and may be linear or branched. Illustrative of the alkyl groups are methyl, ethyl, n-propyl, isopropyl, n-butyl, isobutyl, tert-butyl, n-pentyl, n-hexyl, cyclohexyl, n-heptyl, n-octyl, 2-ethylhexyl, and the like. If the carbon number of each alkyl group is smaller than 1, in other words, in the case of phthalic acid, the diesel engine fuel oil composition forms no uniform liquid phase. Alkyl groups having more than 8 carbon atoms, on the other hand, lead to a diesel engine fuel oil composition the viscosity of which is increased so that fuel feeding through a fuel oil system and fuel injection become difficult. The preferred carbon number may range from 2 to 4, so that ethyl, propyl and butyl are preferred. Dialkyl phthalate compounds usable in the present invention can be used either singly or in combination.

Such dialkyl phthalate compounds can include dimethyl phthalate, dibutyl phthalate, dipentyl phthalate, dihexyl phthalate, diheptyl phthalate, dioctyl phthalate, methyl ethyl phthalate, methyl propyl phthlate, methyl butyl phthalate, methyl pentyl phthalate, methyl hexyl phthalate, methyl heptyl phthalate, methyl octyl phthalate, ethyl propyl phthalate, ethyl butyl phthalate, ethyl pentyl phthalate, ethyl hexyl phthalate, ethyl heptyl phthalate, ethyl octyl phthalate, propyl butyl phthalate, propyl pentyl phthalate, propyl hexyl phthalate, propyl heptyl phthalate, propyl octyl phthalate, butyl pentyl phthalate, butyl hexyl phthalate, butyl heptyl phthalate, butyl octyl phthalate, pentyl hexyl phthalate, pentyl heptyl phthalate, pentyl octyl phthalate, hexyl heptyl phthalate, hexyl octyl phthalate, heptyl octyl phthalate, and the like. Preferred are diethyl phthalate, dipropyl phthalate, dibutyl phthalate, and the like.

(C) GLYCOL ETHER COMPOUNDS

The glycol ether compounds for use in the present invention are represented by the following chemical formula (2):

$$R_3O—(R_5O)m—R_4 \quad (2)$$

wherein $R_3$ is an alkyl group having 1–4 carbon atoms, $R_4$ is a hydrogen atom, an alkyl group having 1–4 carbon atoms or an aliphatic acyl group having 2–4 carbon atoms, $R_5$ is an ethylene or trimethylene group which may contain one or more alkyl side chains having 1–4 carbon atoms, and m is a number of from 1 to 4, with the proviso that m is the number of 1 when $R_5$ is a trimethylene group which may contain one or more alkyl side chains having 1–4 carbon atoms and that $R_3$ and $R_4$ may be the same or different.

The alkyl groups ($R_3$ and $R_4$) in the glycol ether compounds for use in the present invention have 1–4 carbon atoms and may be linear or branched. Illustrative of the alkyl groups are methyl, ethyl, n-propyl, isopropyl, n-butyl, isobutyl, tert-butyl and the like. If the carbon number of each alkyl group is smaller than 1, the diesel engine fuel oil composition forms no uniform liquid phase. Alkyl groups having more than 4 carbon atoms lead to a diesel engine fuel oil composition the viscosity of which is increased so that fuel feeding through a fuel oil system and fuel injection become difficult.

Further, the aliphatic acyl group ($R_4$) in the glycol ether compounds for use in the present invention has 2–4 carbon atoms and may be linear or branched. Illustrative of the aliphatic acyl group are acetyl, butyryl, isobutyryl and the like. An aliphatic acyl group having more than 4 carbon atoms leads to a diesel engine fuel oil composition the viscosity of which is increased so that fuel feeding through a fuel oil system and fuel injection become difficult. The glycol ether compounds can be used either singly or in combination. Preferred are acetyl and isobutyryl.

The ethylene or trimethylene group ($R_5$) may contain one or more alkyl side chains having 1–4 carbon atoms. These alkyl side chains having 1–4 carbon atoms may be linear or branched. Illustrative of these alkyl groups are methyl, ethyl, n-propyl, isopropyl, n-butyl, isobutyl, and the like. Further, m is a number of from 1 to 4. However, m is the number of 1 when $R_5$ is a tri-methylene group which may contain one or more alkyl groups having 1–4 carbon atoms. m greater than 4 leads to a diesel engine fuel oil composition the viscosity of which is increased so that fuel feeding through a fuel oil system and fuel injection become difficult.

Such glycol ether compounds can include ethylene glycol mono-n-butyl ether, ethylene glycol monoisobutyl ether, ethylene glycol mono-tert-butyl ether, ethylene glycol dimethyl ether, ethylene glycol monoisobutyl ether acetate, diethylene glycol mono-n-butyl ether, diethylene glycol monoisobutyl ether, diethylene glycol dimethyl ether, diethylene glycol diethyl ether, diethylene glycol methyl tert-butyl ether, diethylene glycol mono-n-butyl ether acetate, triethylene glycol monomethyl ether, triethylene glycol mono-n-butyl ether, triethylene glycol dimethyl ether, propylene glycol monomethyl ether, propylene glycol mono-n-propyl ether, propylene glycol monomethyl ether acetate, dipropylene glycol monomethyl ether, dipropylene glycol mono-n-propyl ether, dipropylene glycol mono-n-butyl ether, and the like.

Preferred examples include ethylene glycol monoisobutyl ether, diethylene glycol mono-n-butyl ether, diethylene glycol monoisobutyl ether, diethylene glycol dimethyl ether, triethylene glycol mono-n-butyl ether, triethylene glycol dimethyl ether, propylene glycol monomethyl ether acetate, dipropylene glycol mono-n-butyl ether, and the like.

If the content of the one or more dialkyl phthalate compounds employed in the present invention is lower than 2 wt %, the particulate matter (PM)-reducing effect cannot be obtained. If the content is greater than 13 wt %, the resulting composition has a low cetane number so that CO is discharged in a greater amount. If the content of the one or more glycol ether compounds employed in the present invention is lower than 2 wt %, the PM-reducing effect cannot be obtained. Even if the content is greater than 13 wt %, the PM-reducing effect cannot be brought about to such an extent as corresponding to the content so that such a high content is not economical. If the total content of both types of the compounds is smaller than 4 wt %, the PM-reducing effect cannot be obtained. Even if the total content of both types of the compounds is greater than 15 wt %, the PM- and CO-reducing effects cannot be brought about to such an extent as corresponding to the content so that such a high total content is not economical. Accordingly, only when the contents of the one or more dialkyl phthalate compounds and the one or more glycol ether compounds are both from 2 to 13 wt % and the total content of both types of the compounds is from 4 to 15 wt %, is a high cetane number (45 or greater) obtained, are the PM- and CO-reducing effects obtained, and is economy fulfilled. The content of the one or more dialkyl phthalate compounds and that of the one or more glycol ether compounds are both preferably from 2 to 8 wt %, and the total content of both types of the compounds is from 4 to 10 wt %.

The one or more dialkyl phthalate compound(s) and the one or more glycol ether compounds, which are both used in the present invention, can each be used in a form dissolved in a diluent as desired. As the diluent, a known organic solvent can be used. Examples of such a known organic solvent can include saturated aliphatic hydrocarbons such as n-hexane and n-dodecane, aromatic hydrocarbons such as xylene and toluene, and fuel oils such as gas oil. No particular limitation is imposed on the amount of such a diluent to be used, insofar as its amount falls within a range not impairing the performance of the diesel engine fuel oil composition according to the present invention. In general, the diluent can be used in an amount of from 10 to 1,000 parts by weight per 10 parts by weight of the total content of the one or more dialkyl phthalate compounds and the one or more glycol ether compounds.

(D) FUEL OIL ADDITIVES

For the diesel engine fuel oil composition according to the present invention, it is possible to use known fuel oil additives to extents not impairing the performance of the fuel oil composition. Illustrative fuel oil additives can include cetane number improvers, oxidation inhibitors, metal deactivators, detergents, corrosion inhibitors, and the like. These fuel oil additives are disclosed, for example, in "Sekiyu Seihin Additives (Additives for Petroleum Products)" compiled by Toshio Sakurai and published by Saiwai Shobo. Concerning the amounts of these additives, the amount of a cetane number improver, for example, may range from 0.1 to 2.0 wt %, although not limited to this range. These additives can be used either singly or in combination as desired.

For the diesel engine fuel oil composition according to the present invention, it is also possible to use an oxygen-containing compound such as an alcohol compound to an extent not impairing the performance of the fuel oil composition. Examples of the oxygen-containing compound can include aliphatic alcohols such as methanol, ethanol, isopropanol, n-butanol, isobutanol, tert-butanol, amyl alcohol, isoamyl alcohol, n-octanol, 2-ethylhexanol, n-heptyl alcohol, tridecyl alcohol, cyclohexanol, methylcyclohexanol and the like; methyl tert-butyl ether; ethyl tert-butyl ether; and so on. An oxygen-containing compound such as an alcohol compound can be added in an amount of from 0.1 to 10%, although not limited to this range.

EXAMPLES

The present invention will hereinafter be described in further detail by referring to examples. It should, however, be borne in mind that the present invention shall by no means be limited by the following examples. In the following examples, the following mineral oil, dialkyl phthalate compound and diglycol ether compound were used. Cetane numbers were measured on a CFR engine in accordance with JIS K-2280. Discharges of PM and CO were measured following the "Diesel-Powered Automobile 13-Mode Exhaust Gas and Particulate Matter Testing Method" (TRIAS 23-1992).

(1) Mineral Oil

A mineral oil was prepared by blending 70 vol % of a gas oil fraction, which had been obtained by atmospheric distillation of crude oil, with 30 vol % of a catalytic gas oil fraction obtained by catalytic cracking of a heavy oil fraction which had in turn been obtained by the atmospheric distillation of the crude oil. Physical properties of the thus-prepared mineral oil are presented in Table 1.

TABLE 1

| | |
|---|---|
| Specific gravity (15/4° C.) | 0.8451 |
| Distillation characteristics (°C.) | |
| Initial boiling point | 166.0 |
| 10% | 216.0 |
| 50% | 268.0 |
| 90% | 332.5 |
| End point | 367.5 |
| Cetane number | 48.7 |
| H/C (atomic ratio) | 1.8 |

(2) Dialkyl Phthalate Compound

DEP: Diethyl phthalate (product of Tokyo Kasei Kogyo Co. Ltd.; first class grade chemical).

(3) Glycol Ether Compound

DGM: Diethylene glycol dimethyl ether (product of Tokyo Kasei Kogyo Co., Ltd.; first class grade chemical).

(4) Diesel-Powered Automobile 13-Mode Exhaust Gas and Particulate Matter Testing Method For the measurement of discharges of PM and CO in exhaust gas, the "Diesel-Powered Automobile 13-Mode Exhaust Gas and Particulate Matter Testing Method" (TRIAS 23-1992) was followed.

(a) Testing engine and operation conditions

Principal data of a diesel engine employed in the tests are presented in Table 2. On the other hand, operation conditions of the engine are presented in Table 3.

TABLE 2

| | |
|---|---|
| Engine type | Direct injection (Toyota 1W-2) |
| Inner diameter × stroke (mm) | 104 × 118 |
| Number of cylinders | 3 |
| Total displacement (ml) | 4008 |
| Compression ratio | 18 |
| Maximum power output (kgm/rpm) | 27.0/1800 |

TABLE 3

| | |
|---|---|
| Temperature of fuel oil (°C.) | 25.0 |
| Outlet temperature of coolant (°C.) | 80 |
| Temperature of lubricating oil (°C.) | 88 |
| Intake air temperature (°C.) | 25 ± 1 |
| Intake air humidity (RH %) | 50 |

(b) Collecting method and measuring of exhaust gas

From an exhaust pipe, a portion of exhaust gas was collected using a mini-dilution system (manufactured by Tsukasa Sokken K.K.), and discharges of PM and CO were measured using an automobile exhaust gas monitor ("MEXA-900D"; manufactured by Horiba Ltd.). With respect to each of PM and CO, individual discharges produced respectively under the operation conditions of the 13 modes specified in the engine testing method were measured, and its total discharge (g/kWh) was calculated.

EXAMPLES AND COMPARATIVE EXAMPLES

In each of the examples and comparative examples, DEP (diethyl phthalate) and DGM (diethylene glycol dimethyl ether) were added to the mineral oil, followed by thorough mixing to prepare a fuel oil. With respect to the thus-prepared fuel oil, an engine test was conducted to measure discharges of PM and CO. Proportions of DEP and DGM and the measurement results of PM and CO in exhaust gas are presented in Table 4.

TABLE 4

| Examples and | Composition of fuel oil, wt % | | | PM (= TPM), g/kWh | | Cetane |
|---|---|---|---|---|---|---|
| Comparative Examples | DEP | DGM | DEP + DGM | (= SOF + ISF) | CO g/kWH | Number |
| Comparative Example 1 | 0 | 0 | 0 | 0.610 (0.136 + 0.474) | 4.22 | 48.7 |
| Comparative Example 2 | 0 | 3.0 | 3.0 | 0.564 (0.169 + 0.395) | 4.14 | 49.5 |
| Comparative Example 3 | 3.0 | 0 | 3.0 | 0.573 (0.149 + 0.424) | 4.30 | 48.0 |
| Example 1 | 3.0 | 3.0 | 6.0 | 0.528 (0.158 + 0.370) | 4.20 | 49.1 |
| Example 2 | 3.0 | 6.0 | 9.0 | 0.482 (0.145 + 0.337) | 4.11 | 49.8 |
| Example 3 | 3.0 | 11.0 | 14.0 | 0.406 (0.106 + 0.300) | 3.51 | 56.1 |
| Example 4 | 6.0 | 3.0 | 9.0 | 0.491 (0.127 + 0.364) | 4.32 | 47.4 |
| Example 5 | 11.0 | 3.0 | 14.0 | 0.430 (0.115 + 0.315) | 4.52 | 46.0 |
| Comparative Example 4 | 14.0 | 0 | 14.0 | 0.440 (0.122 + 0.318) | 5.40 | 44.7 |
| Comparative Example 5 | 17.0 | 3.0 | 20.0 | 0.400 (0.120 + 0.320) | 5.51 | 44.5 |

TPM (Total Particulate Matter):PM (Particulate Matters)
SOF (Soluble Organic Fraction):Soluble Organic Components
ISF (Insoluble Fraction):Insoluble Organic Components As is apparent from Table 4, the diesel engine fuel oils which contained DEP and DGM in the specific amounts were found to have high cetane numbers and excellent PM- and CO-reducing effects compared with those failing to contain DEP, DGM and/or DEP+DGM in the specific amounts. Namely, the diesel engine fuel oil compositions containing the dialkyl phthalate compound and the glycol ether compound in the specific amounts were substantially reduced in the discharges of PM and CO in exhaust gas while retaining high cetane numbers.

As has been described in detail and specifically, the present invention can provide a fuel oil composition for diesel engines, which retains a high cetane number to have good ignitability for diesel engines and is substantially reduced in the discharges of PM and CO in exhaust gas upon combustion, by adding to a mineral oil 2–13 wt % of one or more dialkyl phthalate compounds represented by the chemical formula (1) and 2–13 wt % of one or more glycol ether compounds represented by the chemical formula (2); and the total content of said components (a) and (b) is from 4 to 15 wt %.

What is claimed is:

1. A fuel oil composition for diesel engines, characterized in that said fuel oil composition comprises a mineral oil as a principal component; and (a) 2–13 wt % of one or more dialkyl phthalate compounds represented by the following chemical formula (1):

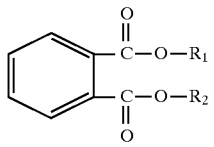

(1)

wherein $R_1$ and $R_2$ are alkyl groups having 1–8 carbon atoms, and $R_1$ and $R_2$ may be the same or different, and (b) 2–13 wt % of one or more glycol ether compounds represented by the following chemical formula (2):

$$R_3O—(R_5O)m—R_4 \quad (2)$$

wherein $R_3$ is an alkyl group having 1–4 carbon atoms, $R_4$ is a hydrogen atom, an alkyl group having 1–4 carbon atoms or an aliphatic acyl group having 2–4 carbon atoms, $R_5$ is an ethylene or trimethylene group which may contain one or more alkyl side chains having 1–4 carbon atoms, and m is a number of from 1 to 4, with the proviso that m is the number of 1 when $R_5$ is a trimethylene group which may contain one or more alkyl side chains having 1–4 carbon atoms; and the total content of said components (a) and (b) is from 4 to 15 wt %.

2. The fuel oil composition of claim 1 wherein the mineral oil contains 50% or more of a petroleum fraction having a flash point of 40° C. or higher and as distillation characteristics, a 90% distillation temperature of 360° C. or lower and a H/C (atomic ratio) of from 1.7 to 1.9.

3. The fuel oil composition of claim 1 wherein in the dialkyl phthalate compound $R_1$ and $R_2$ are the same or different $C_2$–$C_4$ alkyl groups.

4. The fuel oil composition of claim 2 wherein in the dialkyl phthalate compound $R_1$ and $R_2$ are the same or different $C_2$–$C_4$ alkyl groups.

5. The fuel oil composition of claim 1, 2, 3 or 4 wherein the dialkyl phthalate is present in an amount in the range 2 to 8 wt %, the glycol ether compound is present in an amount in the range 2 to 8 wt % and the total amount of both the dialkyl phthalate and the glycol either compound in the fuel oil is in the range 4 to 10 wt %.

6. The fuel oil composition of claim 1, 2, 3 or 4 wherein the dialkylphthalate compound is diethyl phthalate.

7. The fuel oil composition of claim 5 wherein the dialkyl phthalate compound is diethyl phthalate.

8. The fuel oil composition of claim 1, 2 or 4 wherein the glycol ether compound is diethylene glycol dimethyl ether.

9. The fuel oil composition of claim 5 wherein the glycol ether compound is diethylene glycol dimethyl ether.

10. The fuel oil composition of claim 6 wherein the glycol ether compound is diethyl glycol dimethyl ether.

11. A method for reducing the particulate matter and CO discharge in the exhaust gas of diesel engines run on diesel fuel comprising adding to the diesel fuel combusted in said engines from 2–13 wt % of one or more dialkyl phthalate compounds represented by the chemical formula (1):

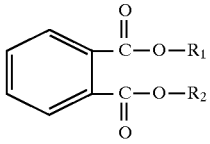

(1)

wherein $R_1$ and $R_2$ are the same or different 1–8 carbon atom alkyl groups, and 2–13 wt % of one or more glycol ether compounds represented by the formula (2):

$$R_3O—(R_5O)m—R_4 \quad (2)$$

wherein $R_3$ is a 1–4 carbon atom alkyl group, $R_4$, is a hydrogen atom, a 1–4 carbon atom ethyl group or a 1–4 carbon atom aliphatic acyl group, $R_5$, is an ethylene or trimethylene group which may contain one or more alkyl side chains having 1–4 carbon atoms, and m is a number of from 1 to 4 with the proviso that m is the number 1 when $R_5$ is a trimethylene group which may contain one or more 1–4 carbon atom and the total amount of dialkyl phthalate compound(s) and glycol ether compound(s) is from 4–15 wt %.

* * * * *